US009683407B2

(12) United States Patent
Diamond

(10) Patent No.: US 9,683,407 B2
(45) Date of Patent: Jun. 20, 2017

(54) ROLLER BLIND ASSEMBLY

(71) Applicant: Fourds Limited, Draperstown, County Londonderry (GB)

(72) Inventor: Cormac Diamond, Draperstown (GB)

(73) Assignee: Fourds Limited, Draperstown, County (GB)

( * ) Notice: Subject to any disclaimer, the term of this patent is extended or adjusted under 35 U.S.C. 154(b) by 0 days.

(21) Appl. No.: 14/433,520

(22) PCT Filed: Oct. 1, 2013

(86) PCT No.: PCT/EP2013/070445
§ 371 (c)(1),
(2) Date: Apr. 3, 2015

(87) PCT Pub. No.: WO2014/053485
PCT Pub. Date: Apr. 10, 2014

(65) Prior Publication Data

US 2015/0252614 A1 Sep. 10, 2015

(30) Foreign Application Priority Data

Oct. 5, 2012 (GB) ..... 1217809.1

(51) Int. Cl.
*E06B 9/08* (2006.01)
*E06B 9/44* (2006.01)
*E06B 9/24* (2006.01)

(52) U.S. Cl.
CPC ..... *E06B 9/44* (2013.01); *E06B 2009/2441* (2013.01)

(58) Field of Classification Search
CPC ..... E06B 9/44; E06B 9/46; E06B 9/48; E06B 2009/2441; E06B 9/40
(Continued)

(56) References Cited

U.S. PATENT DOCUMENTS 1,749,595 A * 3/1930 Mark ..... E06B 9/48 160/400
3,186,474 A * 6/1965 Levitas ..... A47H 23/02 160/238
(Continued)

FOREIGN PATENT DOCUMENTS

DE 202007001597 4/2007
FR 2872850 1/2006
(Continued)

OTHER PUBLICATIONS

PCT International Search Report for corresponding PCT Application No. PCT/EP2013/070445 dated Nov. 11, 2013.

*Primary Examiner* — Blair M Johnson
*Assistant Examiner* — Jeremy Ramsey
(74) *Attorney, Agent, or Firm* — Gardner, Linn, Burkhart & Flory, LLP

(57) ABSTRACT

A roller blind assembly includes a roller, a generally rectangular panel formed from a flexible sheet material having an upper marginal edge secured to the roller and a free lower marginal edge, a screen in the form of a web of flexible material being detachably mounted on the free lower marginal of the panel edge via a releasable fastening device, the releasable fastening device comprising cooperating first and second fastening components being respectively provided on the lower marginal edge of the panel and an upper edge of the screen, wherein the first and second fastening components comprise mating elongate members each having a substantially U shaped cross section to define cooperating hook-like members adapted to releasably engage one another to support the screen from the panel.

8 Claims, 4 Drawing Sheets

(58) Field of Classification Search
USPC ..... 160/108
See application file for complete search history.

(56) References Cited

U.S. PATENT DOCUMENTS

| | | | | |
|---|---|---|---|---|
| 5,450,890 | A * | 9/1995 | Pinkalla | E06B 3/80 160/121.1 |
| 6,876,493 | B1 * | 4/2005 | Lin | E06B 9/40 160/23.1 |
| 7,458,175 | B2 * | 12/2008 | Meyer | G09F 11/30 160/15 |
| 7,510,111 | B2 * | 3/2009 | Mikkelsen | G03B 21/58 235/375 |
| 8,559,104 | B2 * | 10/2013 | Hendricks | G03B 21/58 359/461 |
| 2011/0180219 | A1 * | 7/2011 | Pereira | E06B 9/42 160/89 |

FOREIGN PATENT DOCUMENTS

| | | |
|---|---|---|
| JP | H08121050 | 5/1996 |
| JP | H10292756 | 11/1998 |

* cited by examiner

ROLLER BLIND ASSEMBLY

FIELD OF THE INVENTION

This invention relates to a roller blind assembly for a window or door.

BACKGROUND OF THE INVENTION

Windows are typically provided with screens fitted to the inside of the frame of the window opening, typically fixed to the upper face of the window opening or between the sides of the window opening adjacent the upper face thereof, for selectively obscuring the window. In the case of a roller blind, a roller is mounted at an upper side of the frame around which a suitable screen is wound. The screen may be lowered and raised by rotating the roller. The lower end of the screen may be provided with a bar such that the screen hangs from the roller under gravity. The roller, upon which the screen is wound in convolute manner, is typically located within an elongate cassette adapted to be mounted at an upper side of a window opening.

Over time the screen of a roller blind assembly may become dirty, faded or damaged or it may be desired simply to change the screen, for example when a room is redecorated. This usually requires costly replacement of the entire roller blind assembly.

SUMMARY OF THE INVENTION

According to the present invention there is provided a roller blind assembly wherein a screen can be readily detached from its roller for cleaning or replacement. The assembly includes a roller, a generally rectangular panel formed from a flexible sheet material having an upper marginal edge secured to the roller and a free lower marginal edge, a screen in the form of a web of flexible material being detachably mounted on the free lower marginal of the panel edge via a releasable fastening device, the releasable fastening device comprising cooperating first and second fastening components being respectively provided on the lower marginal edge of the panel and an upper edge of the screen, wherein the first and second fastening components comprise mating elongate members each having a substantially U shaped cross section to define cooperating hook-like members adapted to releasably engage one another to support the screen from the panel.

The first fastening component may be integrally formed on the lower marginal edge of the panel.

The screen may be attached to the second fastening component by one or more of adhesive, crimping, heat sealing or any other suitable attachment method.

Optionally, the screen is detachable from the panel by displacing the second fastening component with respect to the first fastening component in a direction towards the roller.

Optionally, the length of the panel is less than the circumference of the roller.

In one embodiment, the roller may be provided with an elongate recess or channel formed on its outer surface extending substantially over the entire length of the roller and parallel to the axis of the roller for receiving the fastening device when the panel and screen are wound onto the roller. Preferably the shape and dimensions of the roller, and the elongate recess or channel formed thereon, and the fastening device are such that when the panel and the fastening device are wound around the roller, the resulting assembly presents a circular cross section of substantially constant radius.

In another embodiment the roller may be rotatably mounted within an elongate cassette, the cassette having an elongate opening in a lower face thereof through which the screen and at least the marginal edge of the panel may extend.

Optionally, the screen comprises a sheet of fabric or similar flexible material.

The roller may be tensioned, for example by means of a spring, to bias the roller in a winding direction whereby the screen is biased towards a raised or open position with the screen and panel wound onto the roller in convolute manner.

These and other objects, advantages and features of the invention will become apparent upon review of the following specification in conjunction with the drawings.

DESCRIPTION OF THE PREFERRED EMBODIMENTS

Figure 1:
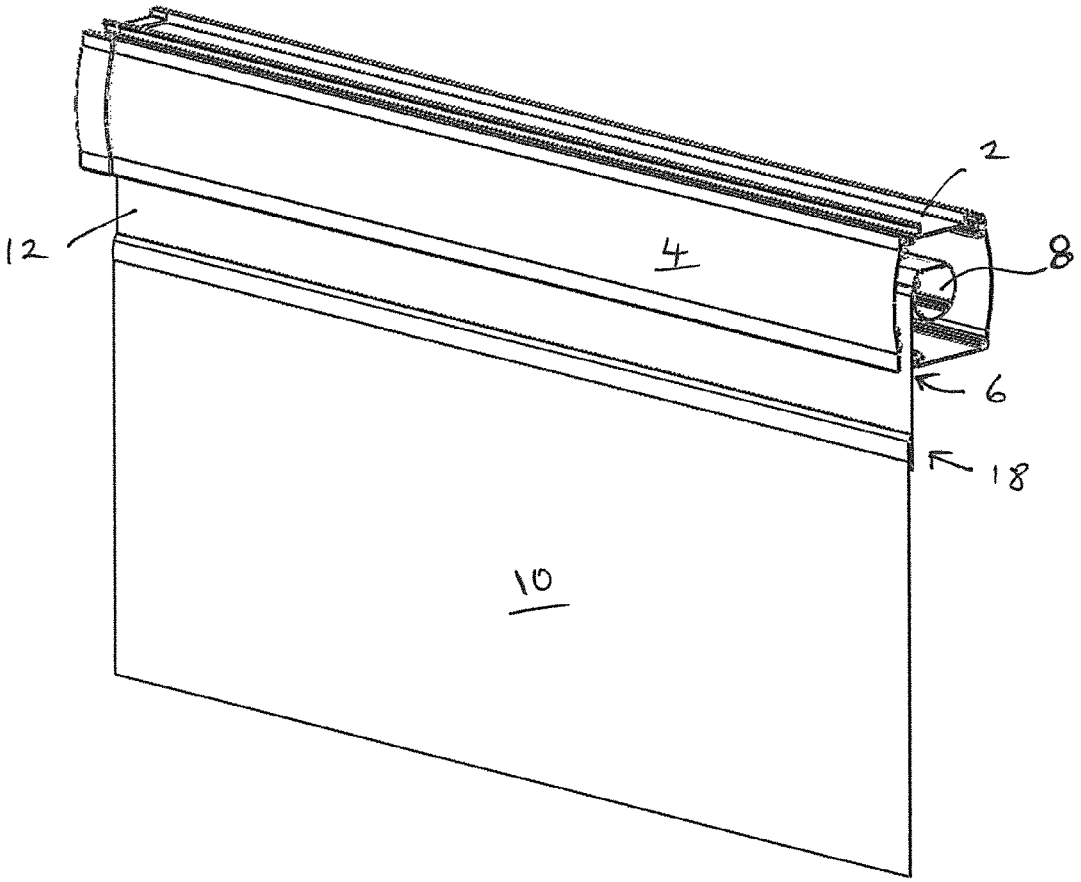
FIG. 1 is a perspective view of a roller blind assembly in accordance with an embodiment of the present invention.

As illustrated in the drawings, a roller blind assembly in accordance with an embodiment of the present invention comprises an elongate cassette 2 adapted to be mounted in an upper side of a window opening, the cassette 2 having a front face 4 defining a head portion of the roller blind assembly and having an opening or slot 6 at a lower side of the front face 4.

A roller 8 is rotatably mounted within the cassette. A fabric screen 10 is supported from the roller 8 such that the screen 10 extends through the slot 6 in cassette 2. The screen 10 can be retracted into the cassette 2 by rotation of the roller 8 such that the screen 10 becomes wrapped around the roller 8 in convolute manner, as in known in the art. The roller 8 may be tensioned, for example by means of a spring, to bias the roller 8 in a winding direction whereby the screen 10 is biased towards a raised or open position with the screen 10 wound onto the roller 8 in convolute manner. The roller 8 may be rotatably by a manual operating mechanism, such as a pull cord or chain, or by a motorised drive to enable the screen 10 to be lowered and raised by rolling and unrolling the screen on the roller in known manner. A rod or bar may be attached to a lower edge of the screen 10 to maintain the screen 10 under tension.

The roller 8 may be formed from aluminium, preferably by an extrusion process, or may be made from any other suitable material.

The screen 10 is attached to the roller 8 via an intermediate web 12 of flexible sheet material. A bead 14 is provided at an upper marginal edge of the intermediate web 12 to be received within an elongate slot 16 formed along the length of the roller 8, parallel to the axis of the roller 8, to attach the intermediate web 12 to the roller 8.

A leading portion 30 of outer surface of the roller 8, ahead of the elongate slot 16 has a radius greater than the remainder or trailing portion 32 of the outer surface of the roller 8 by an amount substantially equal to the thickness of the intermediate web 12 such that the overall diameter of the outer surface of the roller and intermediate web 12 when the intermediate web 12 is wound around the roller 8, is substantially constant around the circumference of the roller 8.

A free lower marginal edge of the intermediate web 12 is provided with a first component 18A of a fastening device 18, a second component 18B of the fastening device 18 being attached to an upper edge of the screen 19, whereby the upper edge of the screen 10 may be releasably attached to the lower marginal edge of the intermediate web 12.

The intermediate web 12 may be formed from a polymeric material, such as PVC, or any other suitable flexible sheet material. This may permit the bead 14 and fastening device 18 to be integrally formed on the respective upper and lower marginal edges of the web 12, for example by injection moulding, or co-moulding from compatible but differing materials, for example different grades of PVC.

Figure 3:
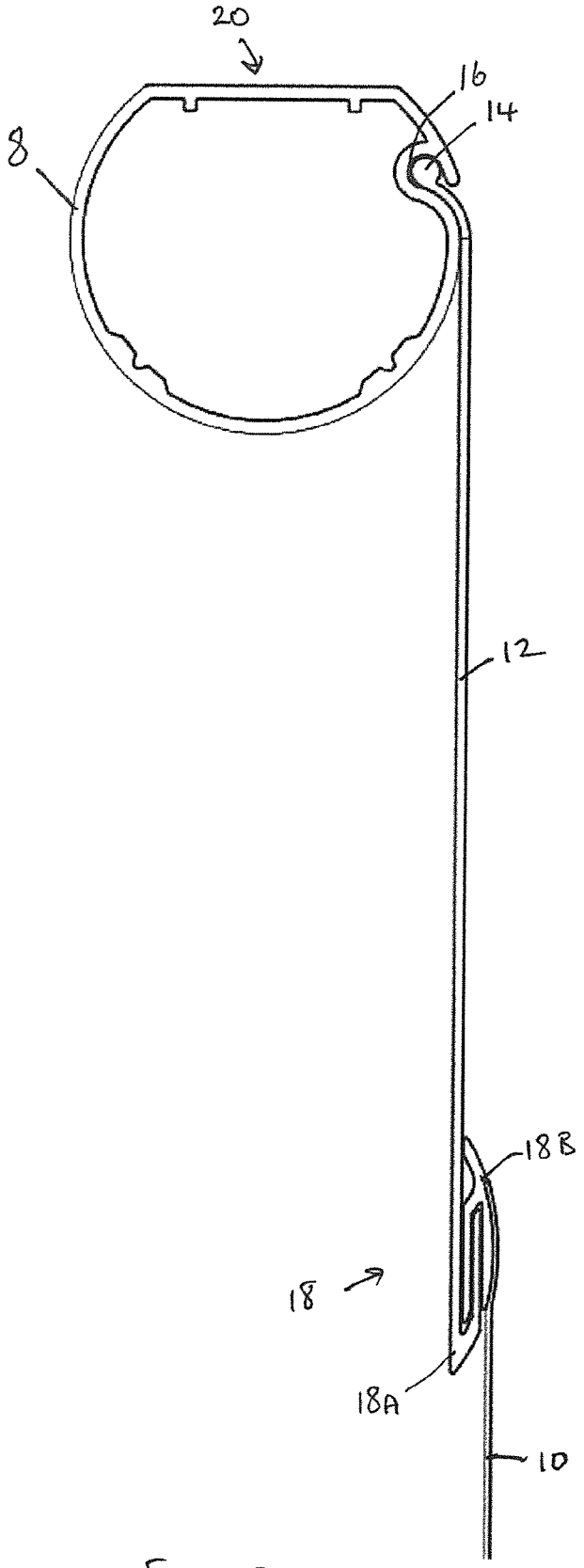
FIG. 3 is a sectional view through the roller blind assembly of FIG. 1.
Figure 4:
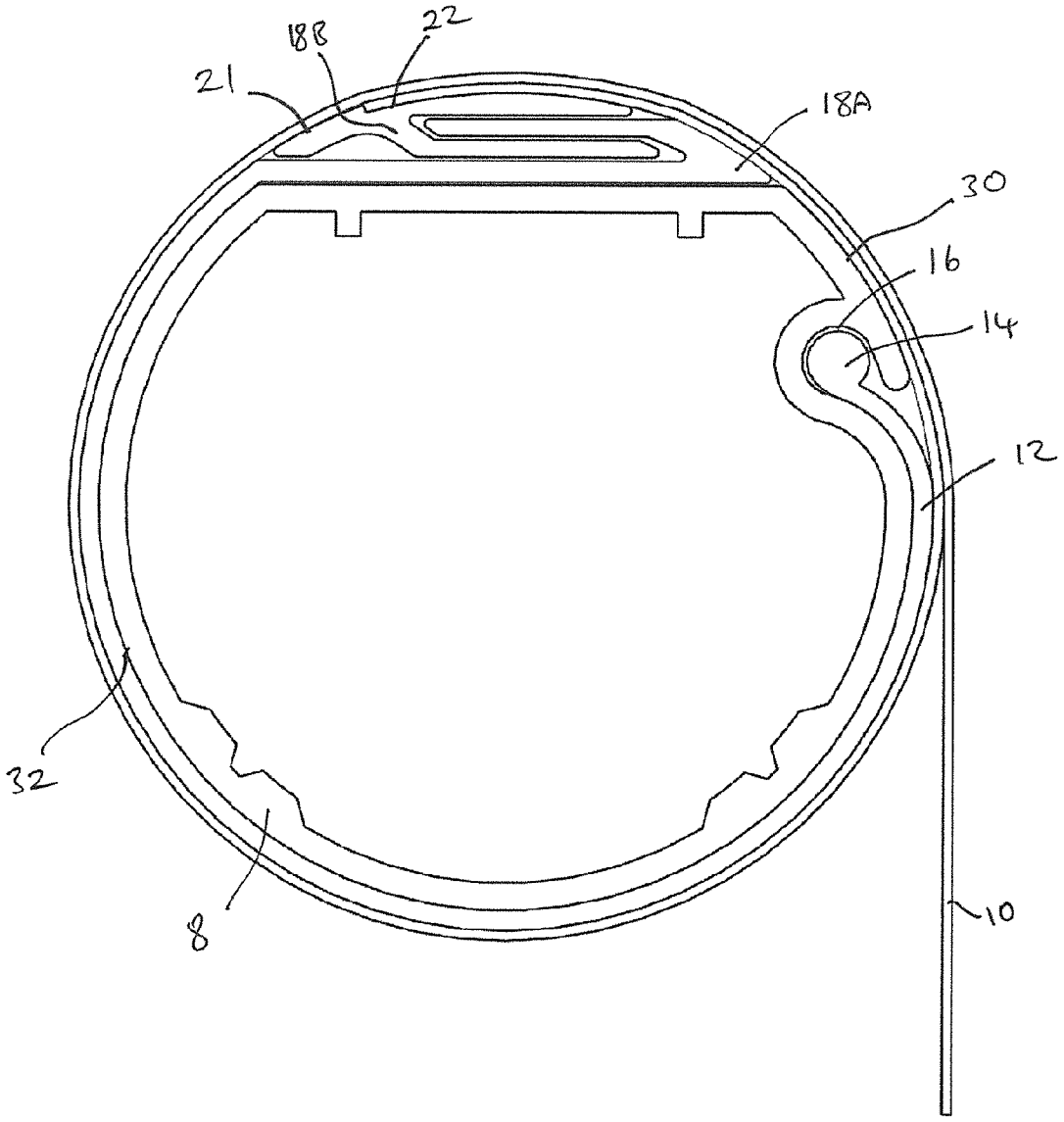
FIG. 4 is a sectional view through the roller blind assembly of FIG. 1, with the screen partially wound around the roller.

As best shown in FIGS. 3 and 4, the fastening device 18 comprises a first elongate hook-like component 18A provided on the lower marginal edge of the intermediate web 12, defining an upwardly open elongate channel, and a second elongate hook-like component 18B, defining a downwardly open elongate channel, provided on the upper edge of the screen 10, the first and second elongate hook-like members being shaped to engage one another to attach the screen 10 to the intermediate web 12, while being readily separable from one another to allow removal and replacement of the screen 10 from the intermediate web 12 by relative displacement of the two components 18A,18B in a vertical direction.

The first component 18A of the fastening device 18 may formed from a resilient material, such as plastic or PVC, and may be integrally formed with the intermediate web 12, as described above. The second component 18B of the fastening device 18 may be formed from a plastic material, for example by moulding, and may be attached to the upper edge of the screen 10 by adhesive, crimping, heat sealing of other suitable attachment methods. The second component 18B may be provided with a recessed region 22 on its outer face 21 adapted to receive the upper edge region of the screen 10, the recessed region 22 having a depth substantially equal to the thickness of the screen 10.

Figure 2:
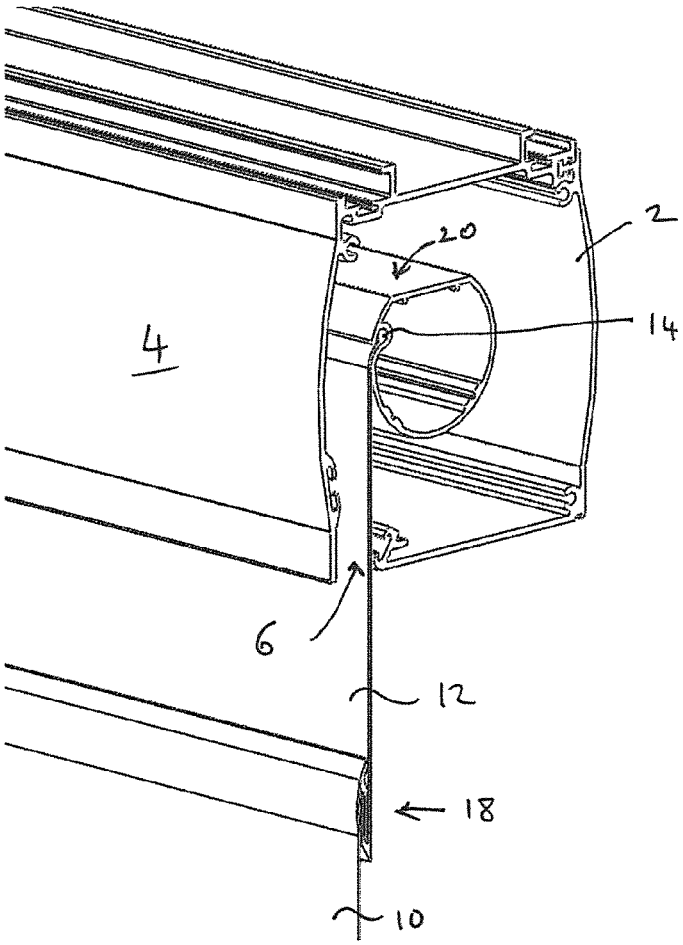
FIG. 2 is a detailed perspective view of an end region of the roller blind assembly of FIG. 1.

The length of the intermediate web 12 is less than the circumference of the roller 8 such that the intermediate web 12 can be wound onto the roller 8 without overlap. As best shown in FIG. 2, an elongate channel 20 is formed in the outer surface of the roller 8, along the length of the roller 8 and parallel to the axis of the roller 8, the channel 20 and the fastening device 18 being dimensioned and positioned such that the channel 20 receives the fastening device 18 when the intermediate web 12 is wound onto the roller 8 so that the fastening device 18 does not interfere with the winding of the screen 10 onto the roller 8. The fastening device 18 is shaped and dimensioned to fit into the recess 20 when the screen is wound onto the roller 8 so that the screen 10 and presents a circular cross section when wound on the roller 8, an outer surface of the fastening device 18 having a radius of curvature substantially equal to the radius of the roller 8, in particular the radius of the leading portion 30 of the roller 8, as best shown in FIG. 4, such that the roller 8, and the intermediate web 12 and fastening device 18 when wound thereon, present a circular cross section of substantially constant radius.

The length of the screen 10 may be selected so that the intermediate web 12 remains wound onto the roller 8, and thus out of sight within the cassette 2, during normal operation of the roller blind assembly (i.e. during opening and closing of the screen).

When it is desired to remove the screen 10 for cleaning or to replace the screen 10, the roller is rotated to fully unwind the screen 10 and the intermediate web 12 from the roller 8 to expose the fastening device 18, as shown in FIG. 1. In such position, the screen 10 can be readily detached from the intermediate web 12 by manipulation of the fastening device 18 to separate the first and second parts 18A,18B of the fastening device.

This arrangement enables the screen 10 to be readily removed for cleaning and allows the screen to be replaced or interchanged, without requiring access to the roller 8, by simply detaching the screen 10 from the intermediate web 12 via the fastening device 18. Thus the appearance of the roller blind assembly can be easily, quickly and cheaply altered by simply interchanging the screen 10 with one of a different colour or pattern. In addition, the flat screen 10 may be replaced by other types of screen, such a roman blind having pleated portions, providing even greater flexibility.

The invention is not limited to the embodiment(s) described herein but can be amended or modified without departing from the scope of the present invention.

The invention claimed is:

1. A roller blind assembly comprising a roller, a generally rectangular panel formed from a flexible sheet material having an upper marginal edge secured to the roller and a free lower marginal edge, a screen in the form of a web of flexible material being detachably mounted on the free lower marginal edge of the panel via a releasable fastening device, the releasable fastening device comprises a single elongate first fastening component and a single elongate second fastening component being respectively provided on the lower marginal edge of the panel and an upper edge of the screen, wherein the first and second fastening components comprise mating elongate members each having a substantially U-shaped cross section to define cooperating cross-sectionally U-shaped hook members adapted to releasably engage one another to support the screen from the panel, wherein the roller is provided with an elongate recess or channel formed on its outer surface extending substantially over the entire length of the roller and parallel to the axis of the roller for receiving the fastening device when the panel and screen are wound onto the roller, and wherein the shape and dimensions of the roller, and of the elongate recess or channel formed thereon, and of the fastening device, are such that when the panel and the fastening device are wound around the roller the resulting assembly of the roller and the first and second fastening components presents a circular cross section of substantially constant radius, and wherein the first fastening component of the fastening device comprises a first elongate generally U-shaped cross sectional hook component provided on the lower marginal edge of the panel and defining an upwardly open elongate channel, the second fastening component of the fastening device comprises a second elongate generally U-shaped cross sectional hook component defining a downwardly open elongate channel provided on the upper edge of the screen, the first and second elongate generally U-shaped cross sectional hook components of the fastening device being shaped to initially engage one another in a first lateral direction that is substantially orthogonal to the upwardly open elongate channel and the downwardly open elongate channel, and to further engage one another in a first longitudinal direction that is substantially perpendicular to the first lateral direction and distally away from the roller to attach the screen to the panel, while being readily separable from one another in a second longitudinal direction toward the roller and opposite the first longitudinal direction to allow removal and replacement of the screen from the panel by relative displacement of the first and second fastening components in use, and wherein the first and second elongate generally U-shaped cross sectional hook components of the fastening device are shaped to be inseparable from one another in the first vertical direction, in the first lateral direction, and in a second lateral direction that is opposite the first lateral direction.

2. A roller blind assembly as claimed in claim 1, wherein the first fastening component is integrally formed on the lower marginal edge of the panel.

3. A roller blind assembly as claimed in claim 1, wherein the screen is attached to the second fastening component by one or more of adhesive, crimping, and heat sealing.

4. A roller blind assembly as claimed in claim 1, wherein the screen is detachable from the panel by displacing the second fastening component with respect to the first fastening component in a direction towards the roller.

5. A roller blind assembly as claimed in claim 1, wherein the length of the panel is less than the circumference of the roller.

6. A roller blind assembly as claimed in claim 1, wherein the roller is rotatably mounted within an elongate cassette, the cassette having an elongate opening in a lower face thereof through which the screen and at least the marginal edge of the panel may extend.

7. A roller blind assembly as claimed in claim 1, wherein the screen comprises a sheet of fabric or flexible sheet material.

8. A roller blind assembly as claimed in claim 1, wherein the roller is tensioned to bias the roller in a winding direction whereby the screen is biased towards a raised or open position with the screen and panel wound onto the roller in convolute manner.

* * * * *